US008496799B2

(12) United States Patent
Von Gutfeld et al.

(10) Patent No.: US 8,496,799 B2
(45) Date of Patent: Jul. 30, 2013

(54) SYSTEMS AND METHODS FOR IN SITU ANNEALING OF ELECTRO- AND ELECTROLESS PLATINGS DURING DEPOSITION

(75) Inventors: Robert J. Von Gutfeld, New York, NY (US); Alan C. West, Tenafly, NJ (US)

(73) Assignee: The Trustees of Columbia University in the City of New York, New York, NY (US)

( * ) Notice: Subject to any disclaimer, the term of this patent is extended or adjusted under 35 U.S.C. 154(b) by 1162 days.

(21) Appl. No.: 12/208,287

(22) Filed: Sep. 10, 2008

(65) Prior Publication Data

US 2009/0081386 A1 Mar. 26, 2009

Related U.S. Application Data

(63) Continuation-in-part of application No. 11/767,461, filed on Jun. 22, 2007, and a continuation-in-part of application No. PCT/US2006/004329, filed on Feb. 8, 2006.

(60) Provisional application No. 60/980,681, filed on Oct. 17, 2007, provisional application No. 60/845,586, filed on Sep. 19, 2006, provisional application No. 60/815,790, filed on Jun. 22, 2006, provisional application No. 60/650,870, filed on Feb. 8, 2005, provisional application No. 60/675,114, filed on Apr. 25, 2005, provisional application No. 60/700,877, filed on Jul. 20, 2005.

(51) Int. Cl.

| | |
|---|---|
| ***C25D 5/08*** | (2006.01) |
| ***C23C 18/16*** | (2006.01) |
| ***B05D 1/02*** | (2006.01) |

(52) U.S. Cl.
USPC ..... 205/80; 427/421.1

(58) Field of Classification Search
USPC ..... 205/80; 427/421.1
See application file for complete search history.

(56) References Cited

U.S. PATENT DOCUMENTS

| | | | |
|---|---|---|---|
| 2,964,453 | A | 12/1960 | Garn et al. |
| 3,582,478 | A | 6/1971 | Kelly et al. |
| 3,790,738 | A | 2/1974 | Laub et al. |
| 4,098,655 | A | 7/1978 | Ward et al. |
| 4,169,770 | A | 10/1979 | Cooke et al. |

(Continued)

FOREIGN PATENT DOCUMENTS

| | | | |
|---|---|---|---|
| CN | 1793434 | | 6/2006 |
| JP | 60-204899 | A | 10/1985 |

(Continued)

OTHER PUBLICATIONS

U.S. Appl. No. 11/767,461, Nov. 30, 2011 Response to Non-Final Office Action.

(Continued)

*Primary Examiner* — Nicholas A Smith
(74) *Attorney, Agent, or Firm* — Baker Botts, L.L.P.

(57) ABSTRACT

Systems and methods for in-situ annealing of metal layers as they are being plated on a substrate by action of a chemical solution are provided. The in-situ annealing, in conjunction with controlled slow growth rates, allows control of the structure of the plated metal layers. The systems and methods are used for maskless plating of the substrates.

3 Claims, 7 Drawing Sheets

U.S. PATENT DOCUMENTS

| | | | | |
|---|---|---|---|---|
| 4,217,183 | A | 8/1980 | Melcher et al. | |
| 4,229,264 | A | 10/1980 | Graunke | |
| 4,283,259 | A | 8/1981 | Melcher et al. | |
| 4,348,263 | A | 9/1982 | Draper et al. | |
| 4,395,320 | A | 7/1983 | Kasashima et al. | |
| 4,432,855 | A | 2/1984 | Romankiw et al. | |
| 4,497,692 | A | 2/1985 | Gelchinski et al. | |
| 4,629,539 | A | 12/1986 | Imai | |
| 4,895,633 | A | 1/1990 | Seto et al. | |
| 4,904,340 | A | 2/1990 | Miracky et al. | |
| 4,917,774 | A | 4/1990 | Fisher | |
| 4,919,769 | A | 4/1990 | Lin | |
| 5,057,184 | A | 10/1991 | Gupta et al. | |
| 5,202,291 | A | 4/1993 | Charvat et al. | |
| 5,245,847 | A | 9/1993 | Bando et al. | |
| 5,279,702 | A | 1/1994 | Douglas | |
| 5,292,418 | A | 3/1994 | Morita et al. | |
| 5,296,375 | A | 3/1994 | Kricka et al. | |
| 5,338,416 | A | 8/1994 | Mlcak et al. | |
| 5,364,510 | A | 11/1994 | Carpio | |
| 5,378,343 | A | 1/1995 | Kounaves et al. | |
| 5,704,493 | A | 1/1998 | Fujikawa et al. | |
| 5,906,723 | A | 5/1999 | Mathies et al. | |
| 5,928,880 | A | 7/1999 | Wilding et al. | |
| 5,932,799 | A | 8/1999 | Moles | |
| 6,042,712 | A | 3/2000 | Mathieu | |
| 6,110,354 | A | 8/2000 | Saban et al. | |
| 6,159,353 | A | 12/2000 | West et al. | |
| 6,165,630 | A | 12/2000 | Gehlhaar et al. | |
| 6,280,602 | B1 | 8/2001 | Robertson | |
| 6,319,834 | B1 | 11/2001 | Erb et al. | |
| 6,334,980 | B1 | 1/2002 | Hayes et al. | |
| 6,391,559 | B1 | 5/2002 | Brown et al. | |
| 6,423,207 | B1 | 7/2002 | Heidari et al. | |
| 6,509,085 | B1 | 1/2003 | Kennedy | |
| 6,521,118 | B1 | 2/2003 | Starvetsky et al. | |
| 6,532,642 | B1 | 3/2003 | Wingo | |
| 6,787,012 | B2 | 9/2004 | Stanbery | |
| 6,936,167 | B2 | 8/2005 | Hobbs et al. | |
| 7,079,760 | B2 | 7/2006 | Hamelin et al. | |
| 7,192,559 | B2 | 3/2007 | Chow et al. | |
| 2002/0046949 | A1 | 4/2002 | Nakamura et al. | |
| 2002/0125142 | A1 | 9/2002 | Sun et al. | |
| 2002/0195345 | A1 | 12/2002 | Bentsen et al. | |
| 2003/0008473 | A1 | 1/2003 | Sakaguchi et al. | |
| 2003/0029722 | A1 | 2/2003 | Erdosy et al. | |
| 2004/0166504 | A1 | 8/2004 | Rossier et al. | |
| 2005/0173253 | A1 | 8/2005 | Huang | |
| 2005/0224359 | A1 * | 10/2005 | Su et al. | 205/157 |
| 2005/0241948 | A1 | 11/2005 | Han et al. | |
| 2006/0003579 | A1 | 1/2006 | Sir | |
| 2008/0142367 | A1 * | 6/2008 | Von Gutfeld et al. | 205/92 |
| 2008/0245674 | A1 | 10/2008 | von Gutfeld et al. | |
| 2008/0264801 | A1 | 10/2008 | West et al. | |
| 2008/0299780 | A1 | 12/2008 | Elliott et al. | |
| 2010/0084268 | A1 | 4/2010 | Pierce et al. | |
| 2010/0084286 | A1 | 4/2010 | West | |
| 2011/0042201 | A1 | 2/2011 | von Gutfeld et al. | |
| 2011/0104396 | A1 | 5/2011 | von Gutfeld et al. | |

FOREIGN PATENT DOCUMENTS

| | | | |
|---|---|---|---|
| JP | 04-066679 | A | 3/1992 |
| JP | 2011071700 | | 4/2011 |
| WO | WO9510040 | | 4/1995 |
| WO | WO2006086407 | | 8/2006 |
| WO | WO2006110437 | | 10/2006 |

OTHER PUBLICATIONS

U.S. Appl. No. 12/478,591, Nov. 23, 2011 Final Office Action.
U.S. Appl. No. 12/478,591, Nov. 10, 2011 Response to Non-Final Office Action.
U.S. Appl. No. 12/040,378, Dec. 22, 2011 Non-Final Office Action.
U.S. Appl. No. 11/767,461, Jan. 26, 2012 Final Office Action.
U.S. Appl. No. 11/867,399, Feb. 21, 2012 Amendment and Request for Continued Examination (RCE).
U.S. Appl. No. 12/040,378, Apr. 27, 2012 Response to Non-Compliant.
U.S. Appl. No. 12/040,378, Apr. 10, 2012 Notice of Non-Compliant.
U.S. Appl. No. 12/478,591, Apr. 23, 2012 Amendment and Request for Continued Examination (RCE).
U.S. Appl. No. 11/867,399, Oct. 19, 2011 Final Office Action.
U.S. Appl. No. 11/867,399, Aug. 24, 2011 Response to Non-Final Office Action.
U.S. Appl. No. 11/867,399, Mar. 24, 2011 Non-Final Office Action.
U.S. Appl. No. 12/040,378, Oct. 10, 2011 Amendment and Request for Continued Examination (RCE).
U.S. Appl. No. 12/040,378, Oct. 4, 2011 Advisory Action.
U.S. Appl. No. 12/040,378, Sep. 20, 2011 Response to Final Office Action.
U.S. Appl. No. 12/040,378, Jun. 9, 2011 Final Office Action.
U.S. Appl. No. 12/040,378, Mar. 28, 2011 Response to Non-Final Office Action.
U.S. Appl. No. 12/040,378, Oct. 28, 2010 Non-Final Office Action.
U.S. Appl. No. 11/767;461, Aug. 9, 2011 Non-Final Office Action.
U.S. Appl. No. 12/478,591, Aug. 10, 2011 Non-Final Office Action.
T. Kikuchi et al., "Local surface modification of aluminum by laser irradation", *Electrochimica Acta*, 2001: 225-234.
Lowenheim, F., Ed. John Wiley & Sons Inc.; Modem Electroplating; (3rd Edition); 194: 591-625.
O. Mallory, Glenn; Hajdu, Juan B.; Fundamentals and Applications; American Electroplaters and Surface Finishers Society; 1990: 193-204.
Ogden et al., "Cylic Voltaammetric Stripping Analysis of Copper Plating Baths", *Applications of Polarization Measurements in the Control of Metal Deposition*, 1984: 229-240.
Wills et al., "Laser micromachining of indium tin oxide films on polymer substrates by laser-induced delamination", *J. Phys. D: Appl. Phys.*, 42 (2009) 045306 (8pp).
U.S. Appl. No. 11/867,399, Aug. 21, 2012 Non-Final Office Action.
U.S. Appl. No. 11/767,461, Oct. 3, 2012 Final Office Action.
Darling, et al., "Integration of microelectrodes with etched microchannles for in-stream electrochemical analysis", *Micro Total Analysis Systems*, pp. 105-108 (1998).
U.S. Appl. No. 12/478,591, Jul. 9, 2012 Notice of Allowance.
U.S. Appl. No. 12/040,378, Jun. 28, 2012 Final Office Action.
U.S. Appl. No. 11/767,461, Jul. 20, 2012 Amendment and Request for Continued Examination (RCE).
U.S. Appl. No. 11/767,461, Jul. 6, 2012 Advisory Action.
U.S. Appl. No. 11/767,461, Jun. 26, 2012 Response to Final Office Action.
U.S. Appl. No. 12/040,378, Dec. 11, 2012 Non-Final Office Action.
U.S. Appl. No. 12/040,378, Nov. 27, 2012 Amendment and Request for Continued Examination (RCE).
U.S. Appl. No. 11/767,461, Feb. 11, 2013 Applicant Initiated Interview Summary.
U.S. Appl. No. 11/767,461, Feb. 7, 2013 Response to Final Office Action.
U.S. Appl. No. 11/867,399, Jan. 28, 2013 Response to Non-Final Office Action.
U.S. Appl. No. 12/940,703, dated Feb. 28, 2013 Non-Final Office Action.
U.S. Appl. No. 11/767,461, dated Mar. 6, 2013 Advisory Action.
U.S. Appl. No. 11/867,399 dated Mar. 11, 2013 Notice of Allowance.

* cited by examiner

Plating a set of substrates which are electrical connectors held together by a metal rail. The rail will be heated and conduct heat to the connectors which are undergoing plating.

A section of rail with connector elements moving behind an anode with holes–receiving laser light from a single cw laser, (or pulsed if coordinated with connector motion) the light split by graded semi–transparent mirrors Similar to 7, but for plating a solid piece where the anode is transparent (e.g. with a conducting coating such as ITO). The laser is scanned over the part through the transparent anode by way of a two dimensional scanning mirror to cause annealing during the slow plating process

SYSTEMS AND METHODS FOR IN SITU ANNEALING OF ELECTRO- AND ELECTROLESS PLATINGS DURING DEPOSITION

CROSS REFERENCE TO RELATED APPLICATIONS

This application claims priority to U.S. Provisional Patent Application Ser. No. 60/980,681, filed Oct. 17, 2007, which is incorporated by reference in its entirety herein. This application is also a continuation-in-part of U.S. patent application Ser. No. 11/767,461, filed Jun. 22, 2007, which claims priority to U.S. Provisional Patent Application Ser. Nos. 60/845,586, filed Sep. 19, 2006 and 60/815,790, filed Jun. 22, 2006 and is a continuation-in-part of International Application No. PCT/US06/04329, filed Feb. 8, 2006, which claims priority to U.S. Provisional Patent Application Ser. Nos. 60/650,870, filed Feb. 8, 2005; 60/675,114, filed Apr. 25, 2005; and 60/700,877, filed Jul. 20, 2005, all of which are incorporated by reference in their entireties herein.

BACKGROUND OF THE INVENTION

The present invention relates to systems and methods for metal plating. More particularly, the invention relates to techniques for controlling the structure and properties of electroplated and electroless plated metals.

Metal plating of articles or base substrates is a common industrial practice. A metal layer may be coated or plated onto the surface of an article, for example, for decoration, reflection of light, protection against corrosion, or increased wearing quality. Articles or base substrates, which are made of metal or non-metallic material, may be plated with suitable coating metals using techniques such as electroplating, electroless plating, metal spraying, hot dip galvanizing, vacuum metallization or other available processes. Plating by electrolysis, or electroplating, is a commonly used technique for metal plating because it permits the control of the thickness of the plating. Cadmium, zinc, silver, gold, tin, copper, nickel, and chromium are commonly used plating/coating metals. In immersion or electroless plating, some metals are directly precipitated, without the application of externally applied sources of electricity, from chemical solutions onto the surface of the substrates. The silvering of mirrors is a type of plating in which silver is precipitated chemically on glass. Any of the common metals and some nonmetals, e.g., plastics, with suitably prepared (e.g., etched) surfaces can be used as the article or base substrate material.

A coated or plated metal layer may have structural properties (e.g., grain size, grain orientation, density, porosity, etc.) that are different from other forms of the metal (e.g., bulk material or sprayed materials) because of their different manner of preparation. The structural properties of the coated or plated metal layer, depending on the method of preparation, can in some instances be advantageous or disadvantageous for certain applications. For example, porosity can be detrimental with respect to corrosion, machined finish, strength, macro hardness and wear characteristics. Conversely, porosity can be advantageous with respect to lubrication (porosity acts as reservoir for lubricants), increasing thermal barrier properties, reducing stress levels and increasing thickness limitations, increasing shock resisting properties, abradability in clearance control coatings, applications in nucleate boiling, etc. Thus, it is desirable to control the structural properties of a coated or plated metal layer according to the desired application properties of the metal layer.

Electro and electroless plating operations using gold and copper deposits have a wide range of applications, from PCBs (printed circuit boards) to automotives and jewelry. However, existing gold-plating technologies have several shortcomings, including higher than desired electrical resistivity, susceptibility to corrosion and significantly higher plating thicknesses of the gold deposit than is intrinsically required, which drives up the cost of the plating process.

Consideration is now being given to improving electro and electroless plating systems and methods. Attention is particularly being directed to techniques for controlling the structural properties of electroplated and electroless plated metals, with particular emphasis on reducing the porosity of the deposit. A principal feature of the present invention is the in-situ annealing of the deposit by controlled heating of the deposit during its growth.

BRIEF DESCRIPTION OF THE DRAWINGS

Further features of the invention, its nature, and various advantages will be more apparent from the following detailed description of the preferred embodiments and the accompanying drawings, wherein like reference characters represent like elements throughout, and in which.

DESCRIPTION

Figure 1:
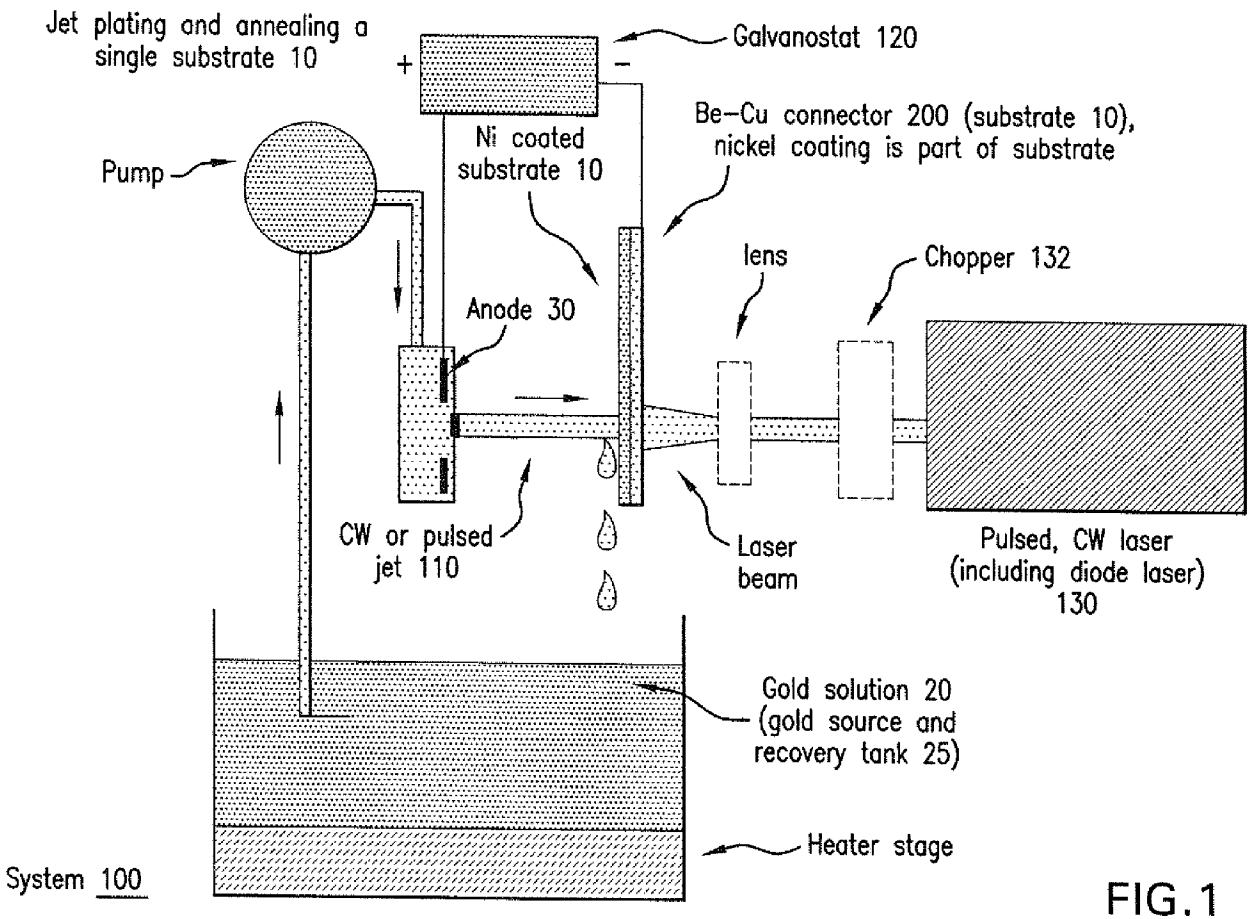
FIG. 1 is a schematic illustration of an exemplary jet plating arrangement for maskless plating, which is configured for in-situ annealing of plated layers during growth, in accordance with the principles of the present invention.

The present invention provides "in-situ" annealing systems and methods for controlling the structural properties of metal plating layers, which are formed by electrolytic or electroless deposition on substrates from solution. Control of the structural properties is achieved by controlled annealing of the layers as they are being deposited or formed. Further, control of the structural properties is achieved by using slow growth phases for the metal plating layers in conjunction with their in-situ annealing. These systems and methods advantageously also enable controlled maskless plating of substrates.

The systems and methods involve directly heating the plating layer deposits during the slow growth of the deposits, either continuously or intermittently. Alternatively, for thin substrates, the systems and methods involve applying heat to the substrate face opposite to the growth face of the deposits to achieve simultaneous growth and annealing of the deposits. The substrates may be movably mounted or attached in thermal contact to a rail. The rail may be heated to conduct heat to the substrates. Alternatively, a laser may be used to heat the substrates attached to a moving rail from the back surface of the connectors. A large substrate may be immersed in solution, and a laser raster pattern scanned across the substrate to heat the entire surface sequentially while the plating layer is growing.

The inventive systems and methods have ready applications in improving common industrial metal coating processes. For example, standard gold electroplating of electronic device connectors generally results in gold layers with high porosity, which leads to a substantial increase in the gold thickness required to prevent corrosion. In turn, the increase in the gold thickness results in an increase in production costs, which could be avoided if the gold plating deposits could be made thinner and yet could effectively prevent corrosion. The inventive "in-situ" annealing systems and methods described herein overcome the porosity problem of such gold plating deposits by controlling their structures by annealing the substrate during the growth phase of the plating process. Gold films having desirable low porosity may be formed by suitable in-situ annealing during deposition. Thus, thinner films may be used as corrosion-resistant films on electronic device connectors with a large cost savings over conventional electroplating methods. In addition to reduced porosity and reduced susceptibility of the substrate to corrosion, the in-situ annealed deposits will exhibit improved adhesion and grain structure.

The known electroplating methods include bath plating and jet plating (with or without laser irradiation). Laser jet plating utilizes a jet of electrolyte which may also serve as an optical waveguide with the laser radiation trapped within the jet. As a result, both laser and jet are collinear and incident on the sample in the same location on the substrate simultaneously. This has been found to result in enhanced growth rates for gold layers and in improved morphology of the gold deposits. For copper, the laser does not affect the growth rate but improves the microstructure and lowers the electrical resistivity of the deposit. Gelshinski et al., U.S. Pat. No. 4,497,692 ("Gelshinski et al.") and R. J. von Gutfeld, J. Opt Soc. Am B/Vol 4, 272 (1987) ("von Gutfeld"), compare the grain structure of gold and copper spots jet-plated on substrates with and without accompanying laser irradiation. For their studies, a concentrated electrolyte jet was directed on substrate surfaces to form the spot deposits at high growth rates. Deposition rates for 0.05 cm diameter gold spots were on the order of 10 micrometers per second. For both gold and copper, micrographs of cross-sectioned deposits show that "with laser" jet-plated samples have superior grain morphology than "without laser" jet-plated samples. Further, the deposits prepared with the laser jet show a significantly lower electrical resistivity compared to those deposits prepared using the jet without the laser based on four point probe resistivity measurements of the samples. It is important to note that the above-referenced experiments all used high growth rates, whereas the present invention relies on slow growth rates (e.g., on the order of 1-10 nm/s) in conjunction with simultaneous thermal annealing to minimize structural defects, particularly in the form of pores residing within the deposited film.

FIGS. 1-7 show systems for implementing methods for controlled in-situ annealing of plated layers during their growth phase, in accordance with the present invention. The in-situ annealing may be accomplished either by directly heating the substrate or, as in the case of thin substrates, heating the substrate face opposite to the growth face. The heating may be either continuous or intermittent, i.e., CW or pulsed.

The systems and methods described herein may be adapted for both patterned and maskless substrate plating operations. The systems may be suitably configured (e.g., for maskless plating of gold onto electronic connectors) with continuous feed material handling systems (e.g., reel-to-reel substrate supply systems).

It will be understood that the systems and methods described herein can be adapted for alloy plating. Pulse plating maybe used (especially for alloy plating in which two or more different chemically reduced ions constitute the deposited layer). The heat source for annealing the deposits in pulse plating also may be pulsed (e.g., in synchrony with the electroplating pulses from a potentiostat or the like) so that each deposited layer or sub-layer of the two or more different ions is annealed in a controlled manner.

As previously noted, the systems and methods achieve control of the structural properties by using slow growth phases for the metal plating layers in conjunction with simultaneous in-situ annealing during growth. Slow growth phases (e.g., with growth rates on the order of 1-10 nm/s) may be achieved by the use of a very dilute electrolyte. The desired slow growth is in contrast with the earlier laser jet system described by Gelshinski et al and von Gutfeld, which was configured for extremely high growth rates. According to the present invention, as the film growth progresses, there is intermittent or simultaneous heating of the deposit during the growth cycle. This manner of heating results in the annealing of incremental thin layers/sub-layers of deposit as they are growing, instead of the more commonly utilized annealing of a cumulative layer after the end of the growth period.

Figure 2:
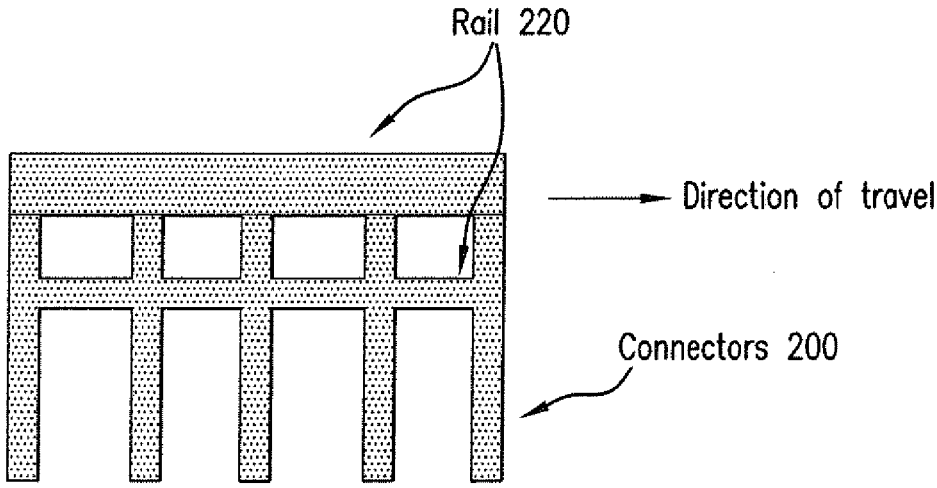
FIG. 2 is a schematic illustration of an exemplary set of substrate connectors for use, in accordance with the principles of the present invention.

FIG. 1 shows an electrolyte jet deposition system 100 for electroplating metals on an exemplary substrate 10. A free-standing jet 110 of electrolyte fluid 20 is directed onto the surface of substrate 10, which, for example, is nickel-coated. A continuous material handling system (e.g., a reel-to-reel system, not shown) may be used to move and position substrate 10 for deposition along rail 220 (FIG. 2). The Be—Cu connectors 200 (FIG. 2), which are in intimate contact with the substrates, are intrinsically attached to the rail (e.g., the connectors and rail may all be stamped from one piece). Sliding or rolling electrical contacts from a power supply can be made to the metal rail to provide Joule heating of the rail. A portion of this heat will be thermally conducted to the substrate connectors 200 and thereform to the substrate in contact for in-situ thermal annealing of the deposit growing on the substrate. Fluid 20, which is composed of dilute plating solution, both resupplies ions to be plated from the source of the plating solution (e.g., a dilute gold salt solution tank 25). Galvanostat 120 is used to apply the necessary voltages for electrolytic action across the length of jet 110 between substrate 10 and anode 30. Jet 110 may be operated in continuous (CW) or pulsed modes for electrolytic deposition of metal (e.g., gold) on the nickel-coated substrate 10.

For in-situ annealing of the growing deposits, system 100 further includes laser 130, which is configured to irradiate and heat substrate 10 from behind as growth of plated metal is occurring on the front surface of substrate 10. Laser 130 may be a pulsed or CW laser. With a CW laser, pulsed irradiation may, for example, be obtained by using a mechanical chopper wheel 132 or a Pockel cell (not shown). The laser pulses incident on the back surface of substrate 10 may be continuous or suitably timed for controlled annealing of the gold or other metal deposits on the substrate. The laser pulses and jet 110 pulses (in pulsed growth mode) may be suitably synchronized for intermittent or concurrent annealing of layers/sub-layers in each growth cycle. The layers/sub-layers may, for example, be intermittently annealed every hundred or so Angstroms of growth.

In system 100 and like systems for in-situ annealing with their relatively slow growth rates, it is beneficial to have the electrolyte circulate, thereby promoting heating of the substrate without unduly heating the electrolyte above the temperature at which it normally operates. In general, for laser heating, a CW or pulsed laser may be selected with a wavelength not readily absorbed by the electrolyte but substantially absorbed by the substrate and the deposit. Where necessary, the electrolyte may utilize a refrigeration stage or temperature controller to maintain its desired temperature. With the proper control of the electrolyte flow velocity and laser power, overheating or boiling of the electrolyte is prevented.

Plating of large parts (substrates) can also be accomplished with in-situ heating during deposition by using a scanning laser that rapidly sweeps across the substrates' surfaces in two dimensions. This method can even be used where the substrate is not necessarily two-dimensional, since the laser can heat areas perpendicular to the planar surface of the substrate should the substrate not be completely planar.

It is expected that laser heating of the substrate from the back surface, i.e., opposite to that of the growth surface (as shown in FIG. 1) for in-situ annealing of growing deposits on the front surface of substrate 10 may be effective for thin substrates on the order of 10-100 mils. Alternatively or additionally, for in-situ annealing of the growing deposits, system 100 may include arrangements of resistive or Joule heating of substrate (connectors) 200 via thermal conduction of the heated rail 220 (FIGS. 2-4).

Further, maskless plating can be achieved in system 100 by suitable design of Be—Cu connector 200 to make electrical and/or thermal contact with selected substrate areas and to heat selected areas. FIGS. 3 and 4 show a Be—Cu connector configuration 300 including an array of individual flat substrate connectors 310. The connectors 310 (e.g., having width "W") are evenly spaced apart (e.g., with spacing "d"). Connectors 310 make sliding electrical contact with a rail 320 as substrate 10 is moved by the material handling system at a pre-selected rate. An optional DC power supply 330 supplies current for Joule heating of rail 320 between selected connectors 310.

Figure 3:
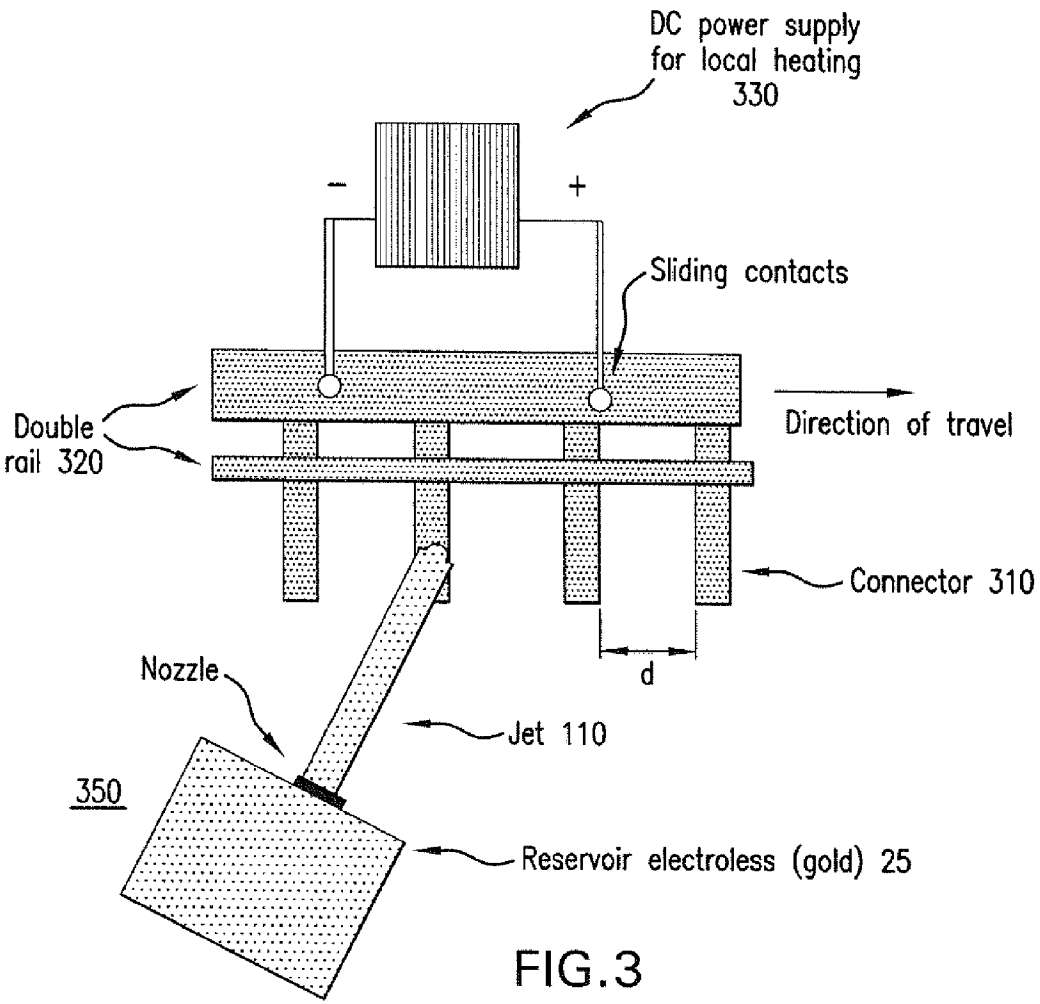
FIGS. 3 and 4 are schematic illustrations of substrate connector configurations for Joule heating of a substrate for in-situ annealing of plated layers during growth, in accordance with the principles of the present invention.
Figure 4:
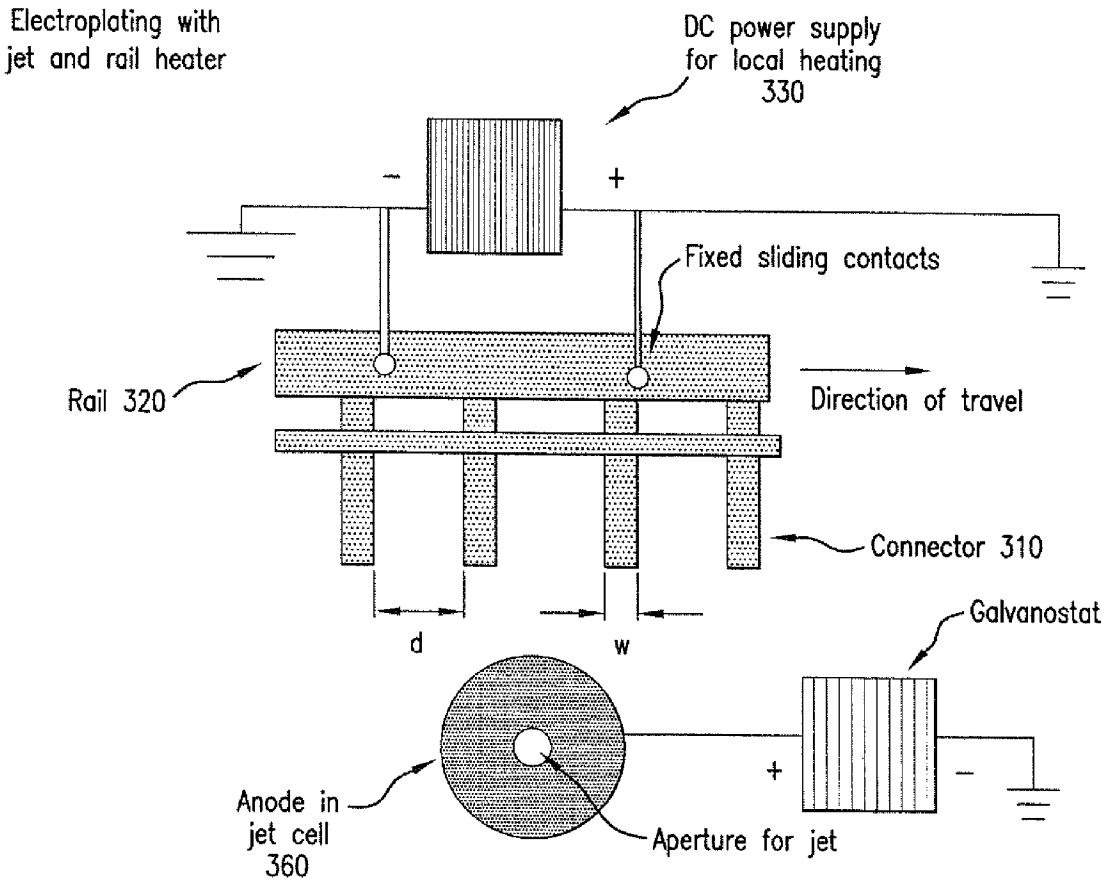

FIG. 3 also schematically shows an alternate anode-free nozzle arrangement 350 for generating electroless deposition jet 110 in system 100. In contrast, FIG. 4 schematically shows an anode/nozzle arrangement 360 for generating electrolytic deposition jet 110 in system 100. It will be understood that the electroless plating system of FIG. 3 may be adapted for electroplating with the addition of suitable anode structures and a galvanostat for applying voltage across the anode and substrate (cathode).

In the case of system 100 shown in FIG. 1, it will be understood that the RPM of chopper 132 must be suitably coordinated with the rate of travel of connectors 310 on rail 320 with consideration of the rate of growth of the plating layers and the desired thickness of the deposit. The rate of growth of the plating layers is a function of the metal concentration in the plating solution, as well as the applied potential between anode and cathode and the rate of flow when using jet plating.

By suitable selection of the aforementioned parameters (e.g., spacing distance d, substrate movement rate, Joule heating current, chopper RPM, rate of growth, etc.), system 100 can be operated to obtain maskless plating in desired patterns, without lithography steps. This maskless plating procedure may advantageously provide cost savings in gold material and lithography, especially when the jet used for jet plating controls the area undergoing plating.

Figure 5:
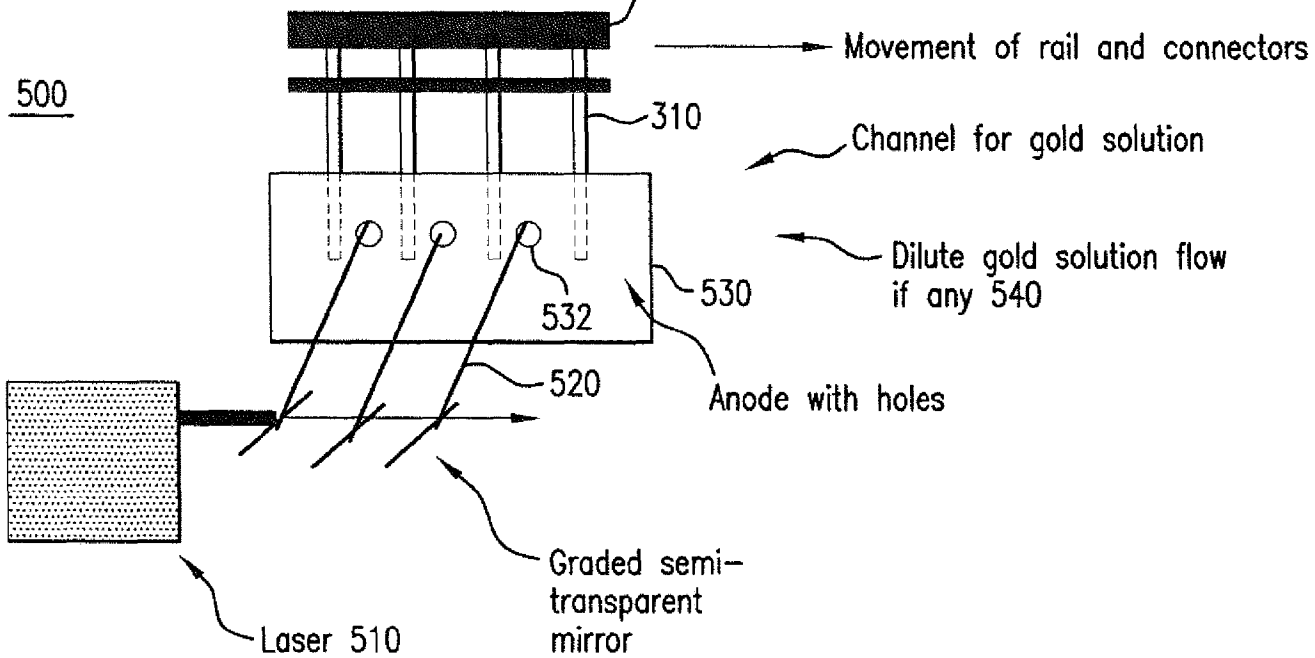
FIG. 5 is a schematic illustration of a system for laser-assisted electrolytic plating on a substrate 10, in accordance with the principles of the present invention.

FIG. 5 shows an alternate system 500 for laser-assisted maskless electrolytic plating on substrate 10. FIG. 5 shows a section of rail 320 with connecter elements 310 and anode 530 having an array of pass-through holes 532 in system 500. The substrates (connectors) 10 are immersed in dilute plating solution 540. In system 500, multiple laser beams 520 are obtained from a single laser 520 using, for example, a split mirror arrangement with each mirror being partially transmissive, partially reflective. The multiple laser beams pass through spaced-apart holes 532 in anode 530, and are incident upon the growth surface of substrate 10. By suitable selection of parameters (e.g., anode hole 532 spacing and connector 310 spacing distances, substrate movement rate, laser pulse rate, rate of growth, etc.), system 500, like system 100, can be operated to obtain maskless plating in desired patterns, without lithographic steps.

Figure 6:
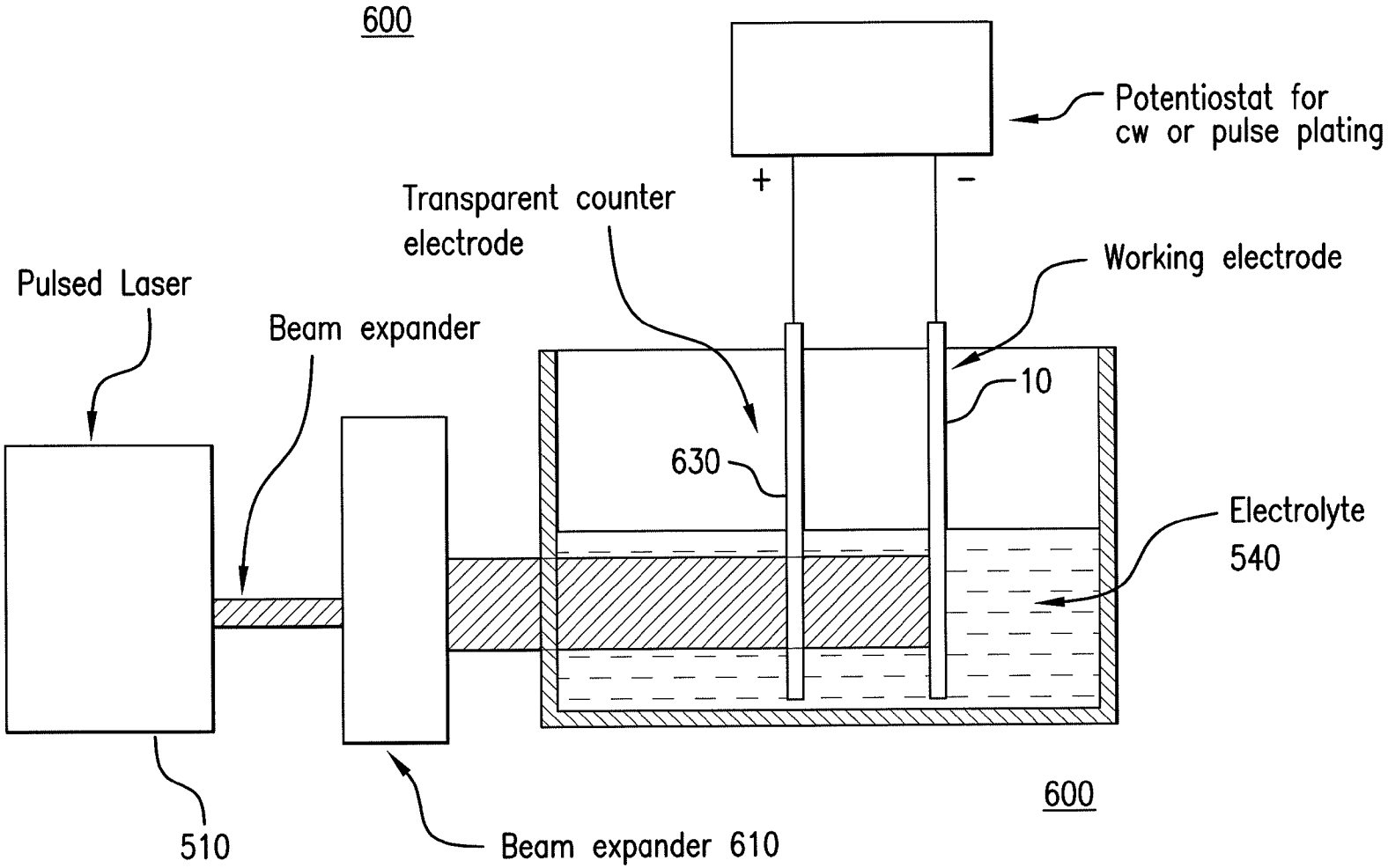
FIGS. 6 and 7 are schematic illustrations of exemplary systems for laser-assisted electrolytic plating on a solid surface of substrate immersed in dilute plating solution, in accordance with the principles of the present invention.
Figure 7:
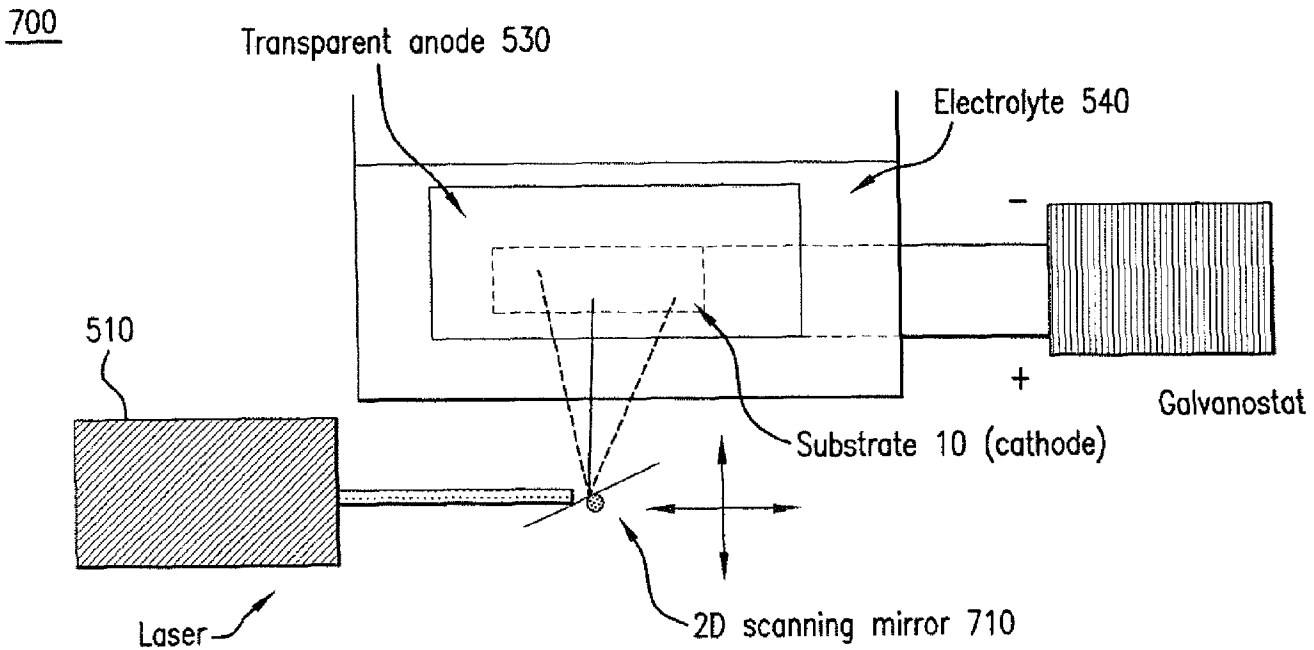

FIGS. 6 and 7 show yet other alternate systems 600 and 700, respectively, for laser-assisted electrolytic plating on a solid surface of substrate 10, which is immersed in dilute plating solution 540. In system 600, anode 630 is transparent (e.g., anode 630 may be a glass plate with a transparent conductor coating of indium tin oxide (ITO)). Laser beams generated by laser 510 may be scanned over the growth surface of substrate 510 using suitable optics (e.g., a beam expander 610 (FIG. 6), or 2-d scanning mirrors 710 (system 700, FIG. 7)) to provide heat for in-situ annealing the growing deposits in their growth phase. For substrates with large surfaces, a scanning laser may be deployed to rapidly sweep and heat the substrate for in-situ annealing during deposition. While growth occurs over the entire substrate, the rapid raster sweeping of a laser over the entire sample effectively anneals small layers during growth over the entire sample. It is also possible to alter the structure of the growth occurring over a given area if desired by either changing the intensity of the laser during raster scanning in a controlled manner or limiting the region over which the laser is rastered (or scanned).

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

It will be understood that in accordance with the present invention, the techniques described herein may be implemented using any suitable combination of hardware and software. The software (i.e., instructions) for implementing and operating the aforementioned rate estimation and control techniques can be provided on computer-readable media, which can include, without limitation, firmware, memory, storage devices, microcontrollers, microprocessors, integrated circuits, ASICs, online downloadable media, and other available media.

What is claimed is:

1. A method depositing a metal layer on a substrate by action of a chemical solution that includes one of an electrolytic and electroless solution of one or more metal ions, the substrate having a front and a back surface and including an array of spaced-apart sections, each of the sections including a first portion in contact with the chemical solution and a second portion coupled with a rail that is not in contact with the chemical solution, the method comprising:

depositing a metal layer on the first portion of each of the plurality of sections of the substrate by action of the chemical solution; and annealing the metal layer in-situ during its growth phase as it is being deposited, wherein the annealing comprises locally heating a portion of the rail while moving the rail along the direction of the array of the spaced-apart sections such that at least some sections in the array of the spaced-apart sections of the substrate are heated at different times by thermal conduction from the portion of the rail being heated.

2. The method of claim 1, wherein the depositing comprises depositing the metal layer at a slow growth rate on the order of 1-10 nm/s.

3. The method of claim 1, wherein locally heating the portion of the rail comprises electrically heating the portion of the rail between two electrical contacts that are fixed in location and slidingly coupled to the rail.

* * * * *